US005369808A

United States Patent [19]

Brewer et al.

[11] Patent Number: 5,369,808

[45] Date of Patent: Dec. 6, 1994

[54] HAT WITH SNUG FITTING ARCUATE HAT BAND

[76] Inventors: Dale A. Brewer; Susan D. Brewer, both of 508 S. 6th St., Denver, Pa. 17517

[21] Appl. No.: 71,062

[22] Filed: Jun. 4, 1993

[51] Int. Cl.[5] ..... A42C 5/00

[52] U.S. Cl. ..... 2/175.3; 2/181.4; 2/DIG. 11

[58] Field of Search ..... 2/171.1, 179, 185 R, 2/186, 199, 311, 312, 338, 175.3, 181, 181.2, 181.4, 181.6, 181.8, 183, DIG. 11, 918

[56] References Cited

U.S. PATENT DOCUMENTS

| | | | |
|---|---|---|---|
| 359,772 | 3/1887 | Burthoul | 2/181 |
| 1,304,215 | 5/1919 | Snyder | 2/181 |
| 1,897,146 | 2/1933 | Richardson | 2/181 |
| 2,580,323 | 12/1951 | Russell | 2/179 |
| 2,879,518 | 3/1959 | Welton | 2/179 |
| 3,374,636 | 3/1968 | Mason | 2/312 |
| 3,664,560 | 5/1972 | Perkins | 2/312 |
| 4,011,600 | 3/1977 | Malk | 2/183 |
| 4,139,130 | 2/1979 | Glusker | 2/312 |
| 4,384,583 | 5/1983 | Speelman | 2/338 |
| 4,439,871 | 4/1984 | Plastino | 2/183 |
| 4,481,681 | 11/1984 | Hankin | 2/181 |
| 4,521,922 | 6/1985 | Mitchell et al. | 2/DIG. 11 |

FOREIGN PATENT DOCUMENTS

| | | | |
|---|---|---|---|
| 3526499 | 11/1986 | Germany | 2/311 |
| 273850 | 5/1930 | Italy | 2/179 |

*Primary Examiner*—Clifford D. Crowder
*Assistant Examiner*—Diana L. Biefeld
*Attorney, Agent, or Firm*—Hartman Underhill & Brubaker

[57] ABSTRACT

An improved hat band adapted to be wrapped around the body of a hat with free ends detachably connected to each other, the band being held in place by tension and slideably adjustable around the hat body to properly position the band on the hat.

5 Claims, 2 Drawing Sheets

Fig. 5
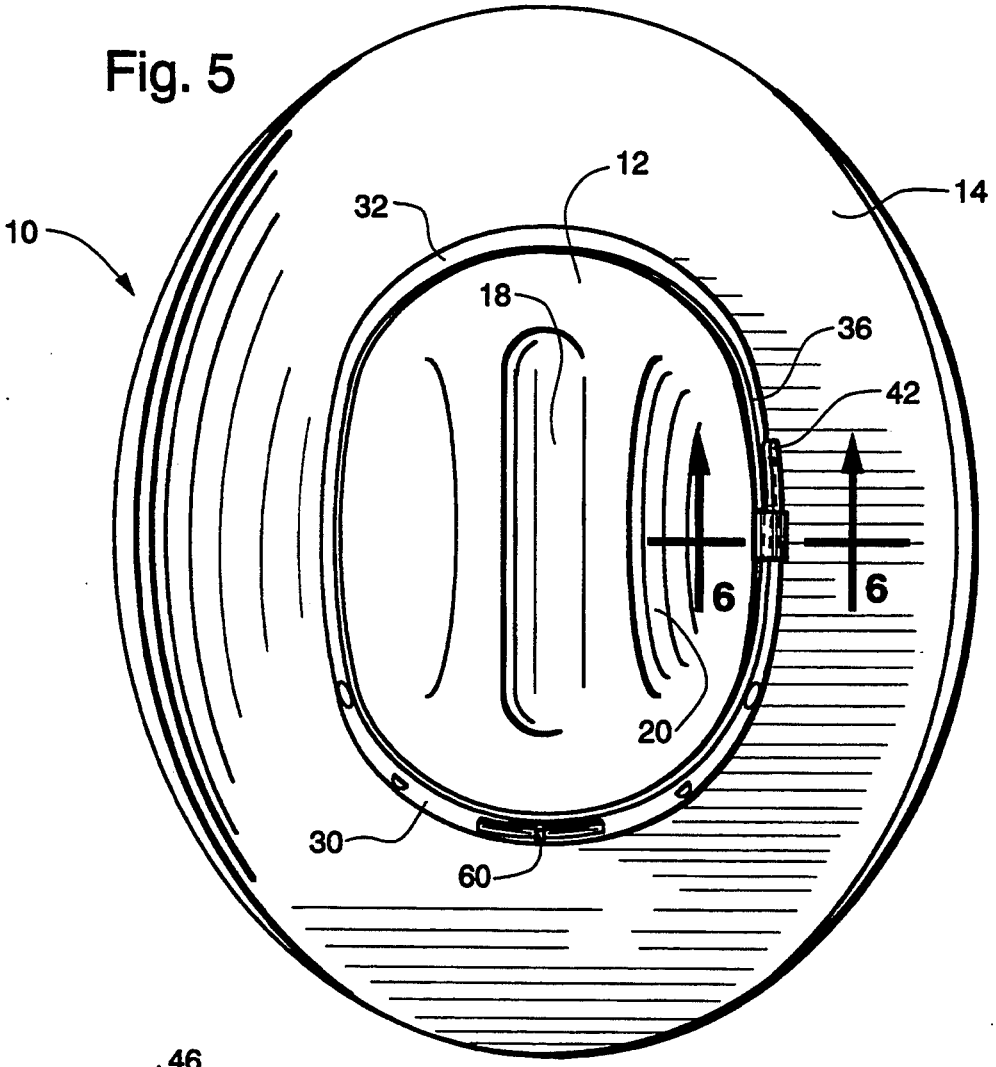
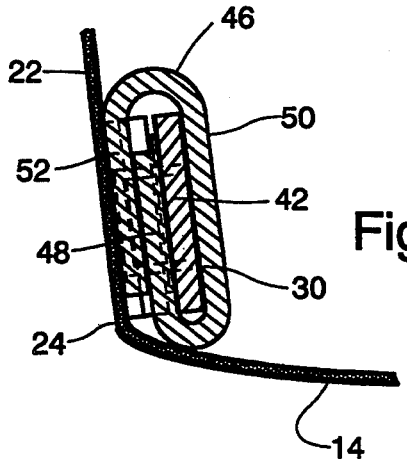
Fig. 6
Fig. 7
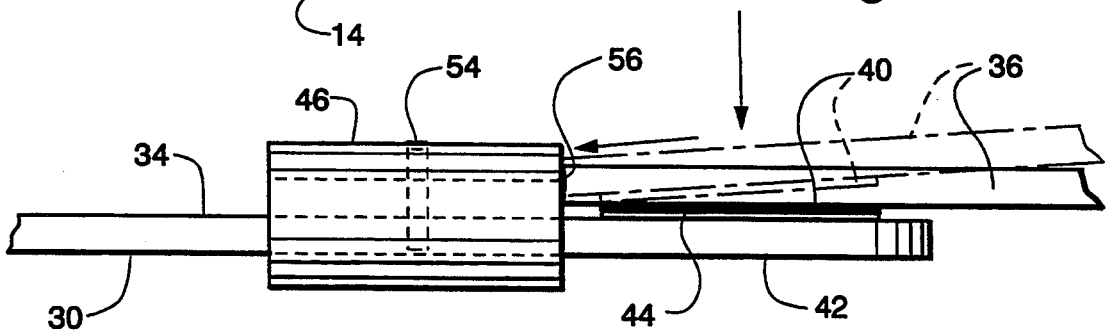

HAT WITH SNUG FITTING ARCUATE HAT BAND

FIELD OF INVENTION

The present invention relates generally to hats and more particularly to an improved hat band.

BACKGROUND

Western style stetson hats are commonly formed in a molded shape having an upstanding body and a brim around a lower end of the body. The shape of the hat body is tapered, being narrower at the top or crown of the hat than at the bottom adjacent the brim and having a size opening so that the body fits the head of the wearer.

Conventionally, a band is applied to the hat surrounding the lower end of the body and seated against the brim. Such band is sometimes decorative, with a medallion or the like adapted to face forwardly relative to the hat when it is worn. In assembling a completed hat, the band is attached to the hat body by one or more rivets which pass through the band and the hat body or by stitching the band in place.

To achieve high productivity, the bands are quickly applied. At times, a band will be attached to a hat body where the band medallion or other marking is off center. Then the hat will not pass inspection. To remove the rivets or stitchings so that the band might be adjusted is time-consuming. Further, damage to the hat body can occur. Therefore, correcting the location error of the band is not an option. A hat reject results thereby increasing production costs.

Further, people who wear western style hats of the type described, sometime desire hats with different hat bands, depending upon the clothes being worn. A band with a particular color might be desired in which case the person might have a number of hats, each with a different band.

SUMMARY

An object of this invention is to provide a hat band for a hat body where there is no direct connection of the band to the body except by tension and a tight fit between the band and the body whereby the band can be rotatably adjusted when positioned on the hat.

Another object of this invention is to provide a hat band shaped to be wrapped around a hat body and to fit snugly against the downward and outward tapered sides of the hat body.

Another object of this invention is to provide an improved hat band for a hat wherein the band has a stop adjacent one free end of the band and engageable by the other free end of the band to establish the inside circumference of the band whereby the band will fit under tension around the hat body, the band free ends being detachably connectable when one free end is in engagement with the stop on the other free end.

A still further object of this invention is to provide an improved hat band whereby if the band is applied to the hat body with a medallion or the like in a misaligned position, the band may be easily rotatably adjusted on the hat body to eliminate the misalignment, with no damage to the hat body occurring.

A still further object of this invention is to provide a set of hat bands of different colors and/or designs adapted to be selectively placed on a hat body, the particular band selected being held in place by tension only around the hat body whereby the bands in the set are readily interchangeable.

Other objects of this invention will be apparent here and after from the specification and from the recital in the appended claims.

DRAWINGS

In the drawings:

FIG. 5 is a plan view of the hat;

FIG. 6 is an enlarged vertical section taken generally on the line 6—6 of FIG. 5 looking in the direction of the arrows; and FIG. 7 is an enlarged fragmentary plan view showing in dotted position how one free end of the hat band is brought into engagement with the stop on the band and then the two free ends are brought together in solid line position to detachably connect them.

DESCRIPTION

Figure 1:
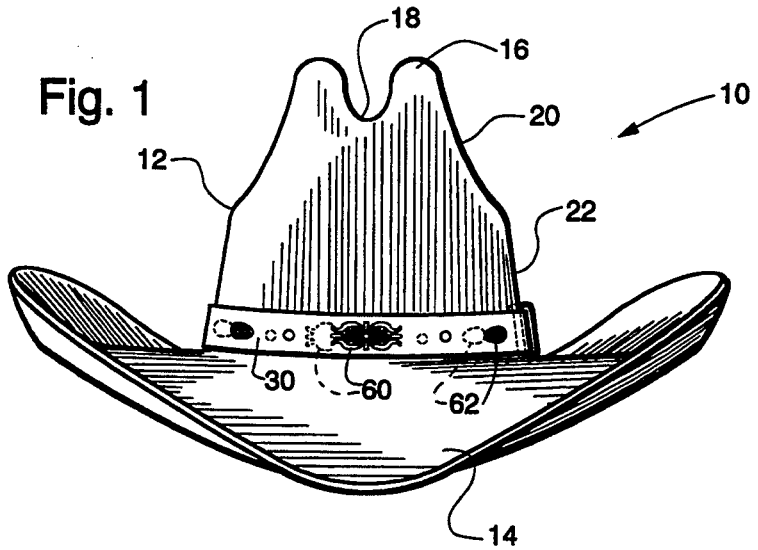
FIG. 1 is a front elevation of a hat having a band constructed according to this invention.

Referring to the drawings by numerals of reference, 10 denotes generally a western style or stetson hat having a hat body 12 and a brim 14. The hat body has a crown portion 16 formed with a dip 18 which extends in a fore and aft direction. The hat has depressions 20 along the sides of the hat body. From crown 16 the hat body extends downwardly and outwardly to form slanted sides 22, which at a lower end 24 (FIG. 6) connects to the brim 14. Such connection may be by sewing the hat body 12 and brim 14 together or an attachment by other means.

Figure 2:
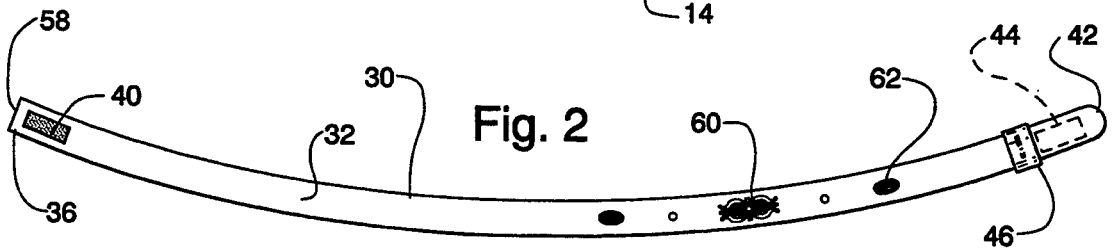
FIG. 2 is a side elevation of the hat band extended lengthwise and showing the arcuate configuration of the band and the detachable means at opposite free ends thereof.
Figure 3:
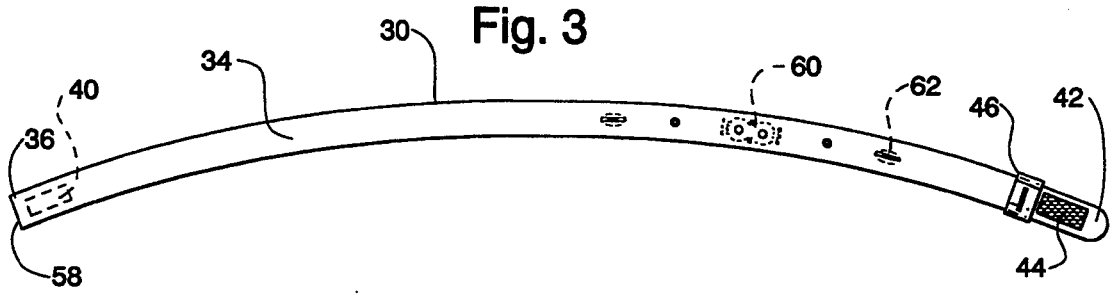
FIG. 3 is a view similar to FIG. 2 but with the band viewed from the opposite side.

Surrounding the lower end 24 of hat body 12 and seated on brim 14 is a band 30 designed according to this invention. Band 30 is formed of a strap of leather, vinyl or other material having an outside wall 32 and an inside wall 34. When stretched at full length (FIGS. 2 and 3), band 30 is arcuately formed or curved along its longitudinal axis to form an arc whereby when the band is wrapped around the lower end 24 of the hat body 12, the band snugly engages the slanted outside surface of side 22 of body 12.

At one free end 36 of hat band 30 on outside wall 32, a hook and a loop pad 40 is provided of rectangular shape and narrower than the width of the band. At the opposite free end 42 of band 30 on the inside wall 34 is a mating hook and loop pad 44. The pads 40 and 42 can be made of Velcro or the like, and when pressed together provide a detachable connection of the ends 36 and 42 of band 30.

Spaced inwardly of pad 44 on the end 42 of hat band 30 is a stop 46 which may be made of the same material as the strap from which the hat band is formed. As shown in FIG. 6, stop 46 is folded to have a first section 48 along the inside wall 34 of band 30, a section 50 along the outside 32 of the band and then an inside section 52 which engages section 48 and the side 22 of hat body 12.

As shown in FIG. 6, stop 46 has two thicknesses of material, 48 and 52, inside band 30 and one thickness 50 outside the band. Stop 46 may be stapled, glued or otherwise connected at 54 to the end 42 of hat band 30. When fastened in place, stop 46 provides a wall surface 56 (FIG. 7) adapted to be engaged by the edge 58 of free end 36 of band 30.

Figure 4:
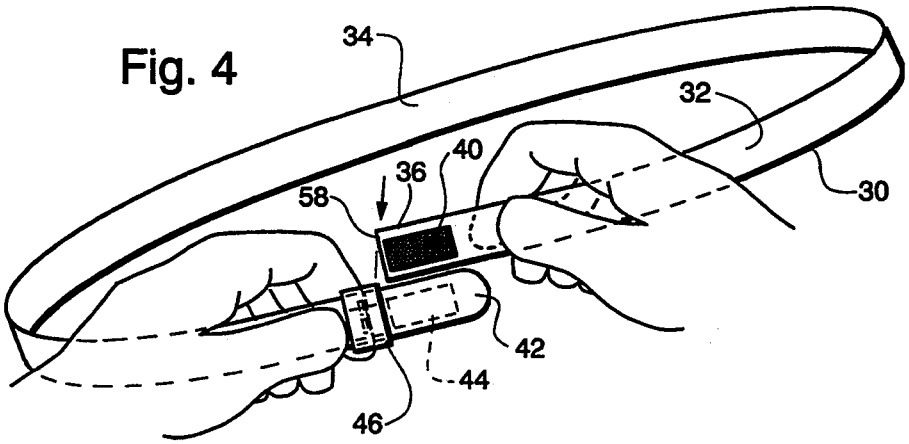
FIG. 4 is a view showing hands forming the band in a loop where the opposite free ends of the band may be detachably connected and showing the stop on the band which establishes the circumference of the inside of the band.

As shown in FIG. 4, with band 30 separate from hat body 12, the band is formed into a loop with the person holding the strap as indicated in the drawing. As shown in FIG. 7, the straight edge 58 of free end 36 of the hat band is adapted to be brought into engagement with the wall 56 of stop 46. End 36 is brought to a point where it engages wall 56, with the band end 36 shown in the dotted line position. Then, the two pads 40 and 44 are pressed together as shown in solid lines to form a detachable connection of the ends.

Stop 46 is so located that it establishes the inside circumference of the band when end 36 engages the wall 56 of the stop. For example, if it is a size seven hat, the circumference will be precisely established so that the band will fit tightly around body 12 of the hat when the band is applied to the hat.

On the outside wall 32 of band 30, a medallion 60 or other decoration may be provided and suitably fastened to band 30. Other decorations 62 may also be applied to the band for decorative purposes. To apply the band 30 on hat body 12, the person merely forms a loop of the band as shown in FIGS. 4 and 7 with the end 36 engaging wall 56 of stop 46. Then the pads 40 and 44 are pressed together detachably interconnecting the ends. When the free end wall 58 of end 36 is brought into engagement with the stop 46, a band loop results which will fit snugly on the hat body 12 when it is slipped over the body. Because of the arcuate shape of band 30, the surface of inside wall 34 will have full engagement with the slanted side 22 of hat body 12.

The hat assembler locates medallion 60 at the front center of hat 10 in alignment with the dip in the crown 18. When the hat band is in place, if the medallion is located somewhat off-center, as shown in the dotted position in FIG. 1, the band 30 is merely rotatably adjusted on the surface of the brim 14 and around the lower end 24 of the hat body 12 until a desired location is achieved. There being no connection other than by tension between band 30 and hat body 12, no riveting or stitching between the band and the hat being employed, the band can be adjusted. The adjustment can be achieved by slideably moving the band. Or, the free ends 36 and 42 can be disconnected, the band 30 adjusted and the detachable connection reestablished.

For different hat sizes, different band lengths are employed. The stop 46 is positioned to establish a circumference of band which will exactly fit the particular hat on which it is to be mounted.

When end 36 is brought into engagement with stop 46 and the pads 40 and 44 are brought into engagement, the pads are not visible from the side of the hat. The end 42 of band 30 extending from stop 46 covers pad 40 on end 36. This provides a desirable appearance.

Instead of having to buy several hats to have a variety of different hat bands, such as blue, green, gold, silver or the like, the purchaser acquires only one hat body with brim, but purchases a set of hat bands. When the hat is to be worn, the user selects the particular band which goes best with the outfit to be worn. Applying the selected band is simple. By bringing one free end into engagement with the stop on the band, the band circumference is established whereby the band will be held by tension on the hat body when slipped into place.

While this invention has been described according to a particular embodiment thereof, it will be understood that variations in design are possible without departing from the concept of this invention.

Having thus described our invention, what we claim is:

1. In a hat having an upstanding body to be worn on the head of a wearer and formed with a crown and sides which slant downwardly and outwardly from the crown to a brim around a lower end of said body, an improved hat band adapted to surround the outside of said body lower end and adjacent said brim;

said band comprising in combination of a strap of flexible material having an inner wall and an outer wall;

said strap being curved along its longitudinal axis to form an arc with opposite free ends and of such shape and length that when the strap is wrapped around said body said inner wall has snug engagement with the body lower end and said free ends of the strap overlap;

and holding means on said strap free ends to detachably fasten the ends together;

said holding means comprising a pair of friction pads, one pad being on the inner wall of one free end of said strap and the other pad being on the outer wall of the other free end of the strap to provide an infinitely variable adjustable connection whereby the circumference of said strap may be varied and fit tightly around the hat body to be held in place by tension;

said strap being slideably adjustable around the hat body when in place to properly position the band on the hat.

2. In a hat as recited in claim 1 wherein the extension of said pads and the overlap of said free ends is such that the pads are hidden from view from the side when the strap surrounds the hat body and the ends are connected.

3. In a hat as recited in claim 1 wherein there is a locator stop comprising a piece wrapped around said strap in a vertical plane with a single thickness along the outside wall of the strap and a double thickness along the inside strip wall whereby an abutment is formed against which the other free end of the strap may be positioned.

4. In a hat having an upstanding body to be worn on the head of a wearer and formed with a crown and sides which slant downwardly and outwardly from said crown to a brim around a lower end of said body, an improved hat band adapted to surround the outside of said body lower end and adjacent said brim;

said band comprising in combination a strap having an inner wall and an outer wall;

said strap being curved along its longitudinal axis to form an arc with opposite free ends and of such shape and length that when the strap is wrapped around said body said inner wall has snug engagement with the body lower end and said free ends of the strap overlap;

a pair of friction pads, one being on the inner wall of one free end of said strap the other pad being on the outer wall of the other free end of the strap;

said pads providing an adjustable connection whereby said strap may be wrapped tightly around the hat body to be held in place by tension;

each pad having a thickness generally the same as the thickness of the strap and when the pads are pressed together their joint thickness approximates said strap thickness;

a locator stop on said strap adjacent one of said free ends and against which the other free end of the strap is adapted to abut; and said locator stop being formed from the same material as said strap and wrapped around the strap with a single thickness along said outside wall of the strap and a double thickness along said inside strap wall whereby an abutment is formed engageable by said other free end of the strap.

5. In a hat as recited in claim 4 wherein a decoration is provided on said strap outer wall, said strap being slideably adjustable around the hat body when in place thereon to properly position said band on the hat with said decoration in desired location relative to said crown.

* * * * *